US007954970B2

(12) United States Patent
Goldburt

(10) Patent No.: US 7,954,970 B2
(45) Date of Patent: Jun. 7, 2011

(54) BOTTLE FOR BEVERAGES

(76) Inventor: Tim Goldburt, Ardsley, NY (US)

( * ) Notice: Subject to any disclaimer, the term of this patent is extended or adjusted under 35 U.S.C. 154(b) by 431 days.

(21) Appl. No.: 11/821,335

(22) Filed: Jun. 22, 2007

(65) Prior Publication Data

US 2008/0314861 A1 Dec. 25, 2008

(51) Int. Cl.
*F21V 33/00* (2006.01)

(52) U.S. Cl. ..... 362/101; 362/253

(58) Field of Classification Search ..... 362/101, 362/253

See application file for complete search history.

(56) References Cited

U.S. PATENT DOCUMENTS

| | | | | |
|---|---|---|---|---|
| 5,211,699 | A * | 5/1993 | Tipton | 362/101 |
| 5,575,553 | A * | 11/1996 | Tipton | 362/101 |
| 7,824,051 | B2 * | 11/2010 | Walter et al. | 362/101 |
| 2005/0207141 | A1 * | 9/2005 | Boesch et al. | 362/101 |

* cited by examiner

*Primary Examiner* — Diane I Lee
*Assistant Examiner* — Sean P Gramling
(74) *Attorney, Agent, or Firm* — I. Zborovsky

(57) ABSTRACT

A bottle for alcoholic or non alcoholic beverages has a hollow body part defining an inner space for filling an alcoholic or non alcoholic beverage, at least one electrical/electronic device integrated in the hollow body part without interfering with a content of the bottle and having a light generating unit and a sensing unit selected from the group consisting of a contact sensor, a movement sensor, and both operative for activating the light generating unit for producing light in response to an action selected from the group consisting of a contact, a movement, and both in a vicinity of the device.

6 Claims, 2 Drawing Sheets

BOTTLE FOR BEVERAGES

BACKGROUND OF THE INVENTION

The present invention relates to beverage bottles for alcoholic or non alcoholic beverages.

Beverage bottles of this type are known in the art in different varieties. One of such beverage bottles is provided with an electrical or electronic device integrated in a hollow body part of the bottle without interfering with a content of the bottle. Such a beverage bottle is disclosed in our patent application Ser. No. 11/588,494. It is believed that existing devices can be further improved.

SUMMARY OF THE INVENTION

Accordingly, it is an object of the present invention to provide a beverage bottle which is a further improvement of the existing beverage bottles.

In keeping with these objects and with others which will become apparent hereinafter, one feature of the present invention resides, briefly stated, in a bottle for alcoholic or non alcoholic beverages, comprising a hollow body part defining an inner space for filling an alcoholic or non alcoholic beverage; at least one device integrated in said hollow body part without interfering with a content of the bottle, said device having light generating means and also sensing means selected from the group consisting of a contact sensor, a movement sensor, and both and operative for activating said light generating means for producing light in response to an action selected from the group consisting of a contact, a movement, and both in a vicinity of said device.

Another feature of the present invention resides, briefly stated, in that said light generating means and said sensing means are configured so that depending on whether there is contact or a movement in the vicinity of the bottle, said light generating means emits different lights.

A further feature of the present invention resides, briefly stated, in that said device has image generating means for generating a text and/or image information in form of a running strip, video images, etc.

A further feature of the present invention resides, briefly stated, in that the device has a power source for power supply to the light generating means and the sensing means and control means for controlling operation of said light generating means and said sensing means.

A further feature of the present invention resides, briefly stated, in said power source includes solar panel means.

The novel features of which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
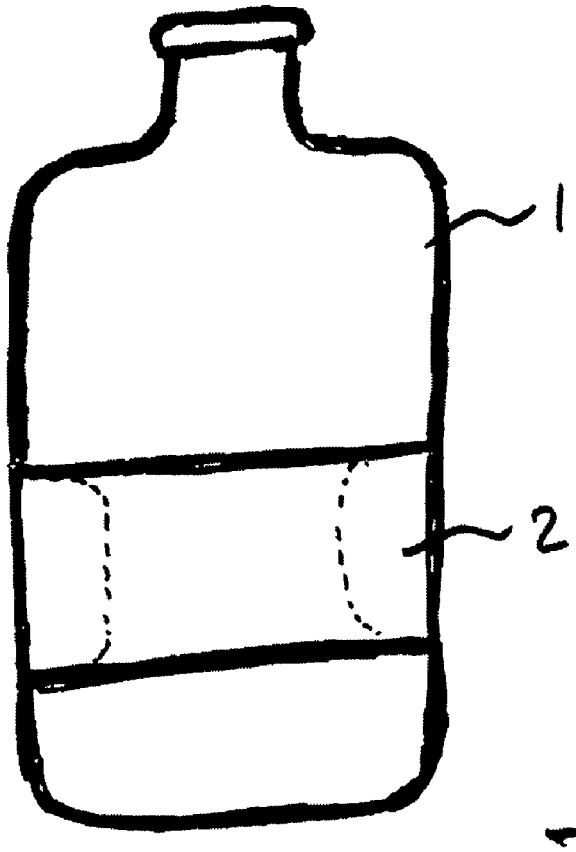
FIG. 1 is a side view of a bottle for beverages, provided with an electrical/electronic device.
Figure 2:
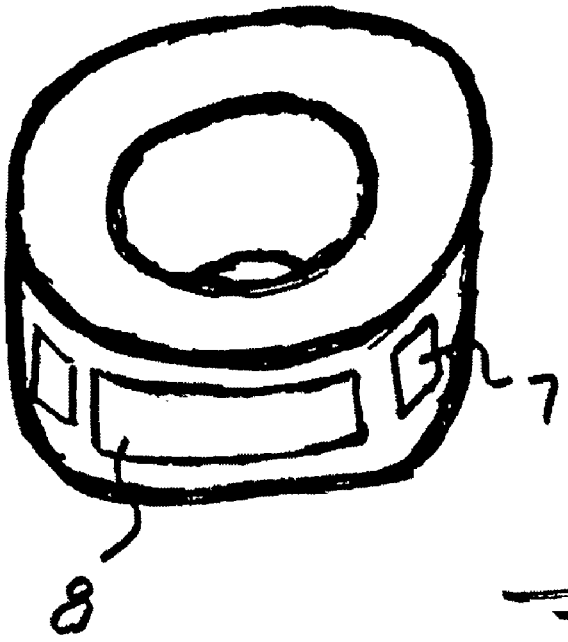
FIG. 2 is a perspective view of the electrical/electronic device of the inventive beverage bottle.
Figure 3:
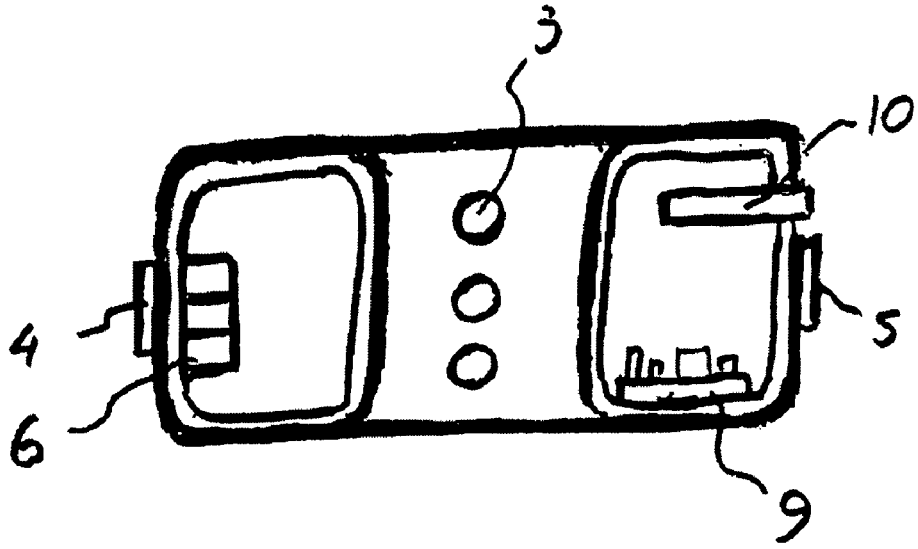
FIG. 3 is a longitudinal cross-section of the electrical/electronic device of the inventive beverage bottle.
Figure 4:
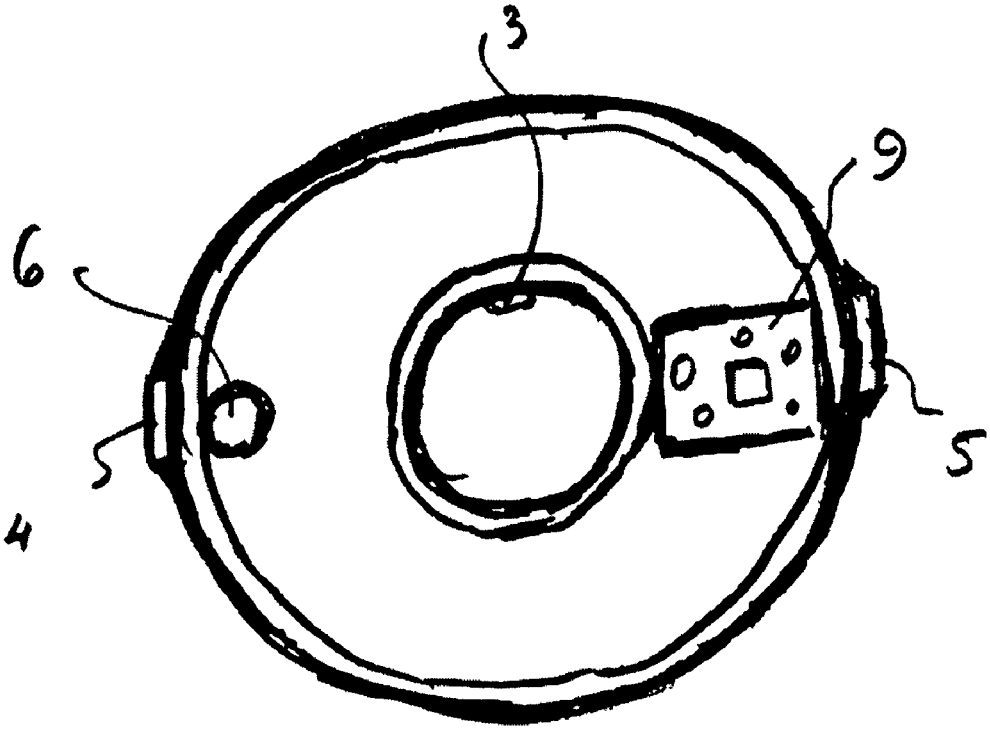
FIG. 4 is a transverse cross-section of the electrical/electronic device of the inventive beverage bottle.

A beverage bottle in accordance with the present invention for alcoholic or non alcoholic beverages has a hollow body which is identified with reference numeral 1 and defines an inner space for accommodating an alcoholic or non-alcoholic beverage.

The beverage bottle further has a device which can be an electrical device or an electronic device and identified as a whole with reference numeral 2. The device 2 is associated with the hollow body part, or more particularly it is arranged on it, for example on a narrowed part of the hollow body part. It can be formed as an annular device having an inner hollow space, as disclosed for example in our patent application Ser. No. 11/558,494.

The device 2 has indicating means 3 formed for example by a light generating means. The light generating means can include several light emitting diodes, each of which can emit light of a corresponding different color. The light emitting diodes can be mounted for example on an inner cylindrical wall of the device 2 and face the interior of the hollow body part 1.

The device further has sensing means. The sensing means include a contact sensor which is identified with reference numeral 4. The contact sensor 4 operates in response to a contact, for example a touch of the sensor 4 by a user.

The sensing means further have a motion sensor which is identified with reference numeral 5. The motion sensor is configured so that it operates in response to a motion of a person or an object in the vicinity of the beverage bottle.

As can be seen from the drawings, the contact sensor 4 can be mounted on an outer circumferential wall of the device 2 at one circumferential location, while the motion sensor 5 can be also mounted in the outer circumferential wall at another location which is circumferentially spaced from the contact sensor 4.

The device further has an electric power source for powering the elements of the inventive device. The power source can include for example batteries identified with reference numeral 6. The power source alternately or additionally can include solar panels which are identified with reference numeral 7 and arranged for example on the outer circumference of the cylindrical wall of the device.

Image producing means are further provided for displaying a text and/or image information in form of a running strip for displaying video images such as movies, etc. These means can be formed for example by a liquid crystal indicator as identified with reference numeral 8 as arranged on the outer surface of the cylindrical wall of the device.

The device is provided with a control unit formed for example as a microprocessor 9. It is connected with all elements 3, 4, 5, 6, 7, 8 of the device, for example by corresponding wires.

The device further has a flash memory storage device for example a flash memory stick 10 for loading text and image data to be displayed by the image generating means 8.

The device 2 of the inventive beverage bottle operates in the following manner.

When for example the contact sensor 4 is activated by touching it by a person or the motion sensor 5 is activated in response to the presence of a person in the vicinity of it, the indicating means generate a corresponding visual indication. For example, in response to touching of the contact sensor 4 the light emitting diodes can be activated so that red and orange colors are alternately emitted in a continuous succession one after the other. When the motion sensor 5 is activated, red and blue colors can be emitted in a continuous succession one after the other. It is understood that for this purpose the light emitting diodes include red, orange and blue diodes which are controlled correspondingly by the microcontroller 9 in response to the sensing of the corresponding situation by the contact sensor 4 and the motion sensor 5.

When the microcontroller 9 receives signals from the sensors 4 and 5, it also activates image generating means 8 for displaying a text information, video images, etc., and this means display corresponding text information, for example in form of a running strip. The text information can include news, advertising, and any other information. This information can be either transmitted remotely from a source, or memorized in the device and activated in response to the operation of the microcontroller 9.

When the indicating means emit lights of corresponding colors by the light emitting diodes, the beverage in the hollow body part 1 is illuminated with corresponding colors.

It will be understood that each of the elements described above, or two or more together, may also find a useful application in other types of constructions differing from the type described above.

While the invention has been illustrated and described as embodied in a bottle for beverages, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A bottle for alcoholic or non alcoholic beverages, comprising a hollow body part defining an inner space for filling an alcoholic or non alcoholic beverage; at least one electrical or electronic device integrated in said hollow body part without interfering with a content of the bottle, said device having light generating means emitting different colors and also sensing means including a contact sensor activating a first color and a movement sensor activating a second different color without activating said first color; wherein said light generating means emit light of said first color activated by said contact sensor in response to a contact with the bottle and said light generating means emit light of said second different color activated by said movement sensor in response to a movement in a vicinity of the bottle.

2. A bottle as defined in claim 1, wherein said device has a power source for supplying electrical power to said light generating means and said sensing means.

3. A bottle as defined in claim 1 for alcoholic or non alcoholic beverages, wherein said device has image-generating means generating images selected from the group consisting of a text, an image information in form of a running strip and both.

4. A bottle as defined in claim 1; and further comprising control means controlling operation of said light generating means and said sensing means.

5. a bottle as defined in claim 2, wherein said power source includes solar panel means.

6. A bottle as defined in claim 1, wherein said device further has flash memory means for loading text and image data.

* * * * *